US007716804B2

(12) United States Patent
Berndl et al.

(10) Patent No.: US 7,716,804 B2
(45) Date of Patent: May 18, 2010

(54) RIVET SETTING METHOD

(75) Inventors: Juergen Berndl, Nandlstadt (DE); Marc Reinstettel, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/018,302

(22) Filed: Jan. 23, 2008

(65) Prior Publication Data

US 2008/0120824 A1 May 29, 2008

Related U.S. Application Data

(63) Continuation of application No. PCT/EP2006/007349, filed on Jul. 26, 2006.

(30) Foreign Application Priority Data

Aug. 10, 2005 (DE) ..... 10 2005 037 914

(51) Int. Cl.
*B21D 39/00* (2006.01)

(52) U.S. Cl. ..... 29/524.1

(58) Field of Classification Search ..... 29/524.1, 29/432.1, 505, 509, 525.06, 432.2, 243.53; 227/52, 55, 77

See application file for complete search history.

(56) References Cited

U.S. PATENT DOCUMENTS

| | | | | |
|---|---|---|---|---|
| 4,106,180 | A * | 8/1978 | Fuhrmeister | 29/432.1 |
| 5,752,305 | A | 5/1998 | Cotterill et al. | |
| 6,938,314 | B2 | 9/2005 | Meichsner et al. | |

FOREIGN PATENT DOCUMENTS

| | | |
|---|---|---|
| DE | 198 16 198 C2 | 10/1999 |
| DE | 101 46 442 B4 | 1/2005 |
| WO | WO 00/29145 A1 | 5/2000 |

OTHER PUBLICATIONS

International Search Report dated Oct. 20, 2006 with an English translation of the pertinent portions (Four (4) pages).

German Office Action dated Apr. 6, 2006 with an English translation of the pertinent portions (Six (6) pages).

Henrob Company History (20 pgs.) [on-line] Retrieved from Henrob website. <URL:http://www.henrob.com/languages/english_us/pdf/company%20history.pdf>.

* cited by examiner

*Primary Examiner*—John C Hong
(74) *Attorney, Agent, or Firm*—Crowell & Moring LLP

(57) ABSTRACT

A method is provided for self-pierce riveting which reduces a setting force required for setting the rivets. For this purpose, a clamping force produced by a clamping device is substituted by the force produced by a rivet on a punch. The clamping force varies within a known magnitude, whereas the setting force is reduced by 20%.

21 Claims, 1 Drawing Sheet

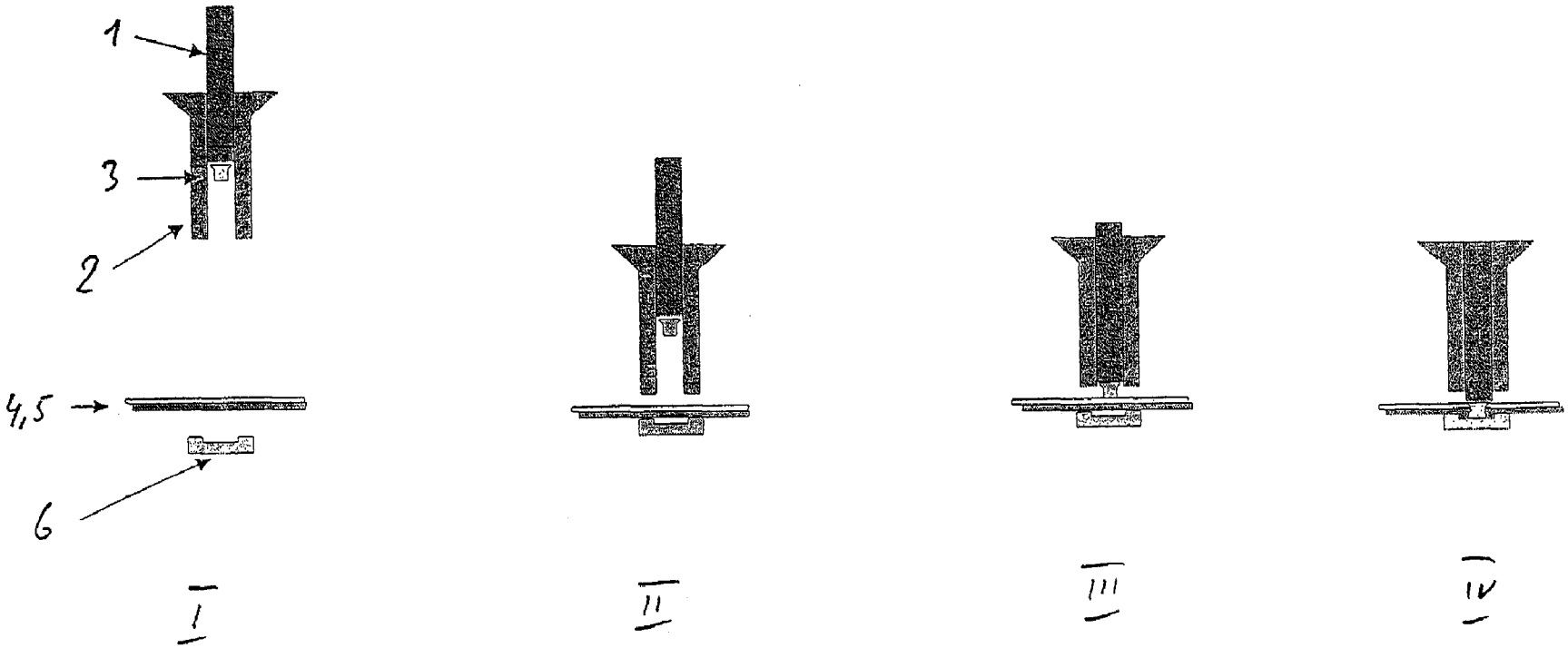
1
3
2
4,5
6
I-I
II-II
III-III

RIVET SETTING METHOD

CROSS-REFERENCE TO RELATED APPLICATIONS

This application is a continuation of PCT International Application No. PCT/EP2006/007349, filed on Jul. 26, 2006, which claims priority under 35 U.S.C. §119 to German Application No. 10 2005 037 914.1, filed Aug. 10, 2005, the entire disclosures of which are expressly incorporated by reference herein.

BACKGROUND AND SUMMARY OF THE INVENTION

The present invention relates to a method for self-pierce riveting, in particular using semitubular punch rivets to connect at least two components, in particular two sheets, with the aid of a self-pierce riveter having a punch. The punch rivet to be set is pressed by the punch through the sheets to be connected.

Self-pierce or punch riveting has been known for many years, including in automobile manufacturing technology. Typically, aluminum sheets are connected with the aid of semitubular rivets at an overlap joint.

Punch riveting is understood as a riveting method in accordance with DIN 8593-5, edition September 2003, in which a solid rivet or semitubular rivet is driven by a punch through at least two non-perforated sheet-like components with the aid of a clamping device. A die is situated on the component side facing away from the punch, which forms the buttress to the clamping device, on the one hand, and is used, on the other hand, for the purpose of deforming the lower component and/or the rivet in the lower component such that a form fitting connection results between the punch rivet and the lower component. If semitubular punch rivets are used, the semitubular punch rivet does not exit from the lower component.

The punch-riveting tool suitable for this purpose typically includes a C-shaped frame, a die being provided on one side and a hydraulically or pneumatically movable punch being provided on the other side, which is enclosed by a clamping device. Punch riveters of this type are typically fastened to robots, which then move the punch riveters to the fastening point.

To set a punch rivet, it is placed in front of the punch. The clamping device then moves down and presses the two components to be connected against the die at the rivet point. Subsequently, while maintaining the clamping force of the clamping device, the punch rivet is driven into the two non-perforated components to be connected. Forces of 30 kN or more are required for this purpose. The clamping forces are in the order of magnitude of 6-7 kN.

A system of this type for a semitubular punch rivet is described in U.S. Pat. No. 5,752,305 A, for example. Clamping forces of a few hundred newtons up to 15 kN are referred to as typical here. With clamping forces at a level of this type according to the US patent, a deep-drawing procedure is to be avoided in the sheets in the area of the punch rivet, which has not proven to be correct in practice, however.

The present invention provides a method for setting punch rivets, in which a reduction of the joining forces is possible while maintaining the known punch riveters.

The present invention provides a method for setting punch rivets, in particular semitubular punch rivets, connecting at least two components, in particular two sheets, with the aid of a punch riveter having a punch. The punch rivet to be set is pressed by the punch through the sheets to be connected. The sheets to be connected are exclusively pressed together via the punch rivet to be set before the setting of the punch rivet, so that a possibly existing gap between the sheets to be connected is nearly removed, and the punch rivet is only set then.

In contrast to the prior art, a clamping device which presses together the sheets to be joined is no longer used, but rather the sheets are pressed together before the actual setting procedure via the punch and the punch rivet itself. The clamping device, which is still present, is only still used for guiding the rivet during the supply of the punch rivet to the surface of the components to be connected by the punch. However, it may no longer apply clamping force, because it no longer touches the components to be connected. Surprisingly, it has been shown that the clamping force to be applied via the rivet is less than previously used and the setting force, i.e., the force with which the punch rivet is driven into the sheets/components, may also be significantly reduced. Therefore, less tool wear arises because of the lower joining forces, and the punch rivet clamp itself may also be minimized in regard to weight and thus material costs. Therefore, even robots having a small carrying force may be used. A further advantage may be seen in that the punch riveters used up to this point may be maintained without structural changes. Only the controller of the clamping device must be altered, so that it is ensured that the clamping device no longer touches the components to be connected.

In a preferred embodiment, the method utilizes a waiting time at a constant clamping force. This waiting time may be used for determining the component thicknesses via a distance measurement of the punch path, which is known per se.

It is also known to simultaneously glue the components to be connected using punch rivets, in that adhesive is applied in spots or strips on the two interior sides of the sheets/components to be connected before the punch rivet is set. To distribute the adhesive on the sheet surfaces before the punch riveting, either longer waiting times are set at constant clamping force, or alternatively, the level of the clamping force may be changed. An advantage of this embodiment is that the air channels otherwise occurring in the adhesive distributed between the sheets when using a clamping device for clamping and thus distributing the adhesive may be significantly reduced.

In particularly preferred embodiments, ranges for the waiting time and for the clamping force when connecting two aluminum sheets of typical configuration are provided, which ranges, i.e., 0.1 to 2 seconds and 2 to 10 kN, are used in automobile manufacturing.

It is noted once again that according to the present invention, the clamping force is exclusively exerted via the punch rivet on the sheets/components to be connected and not—as in practice—via the clamping device.

In the following example, the punch riveting procedure up to this point using semitubular punch rivets is briefly described and compared to the procedure according to the present invention.

Two sheets to be connected are chucked precisely in position in a known manner. A punch riveter fastened to a robot is then moved to the connection point. The punch riveter is typically attached to a rivet stock and a rivet feed unit.

In the method according to the prior art, after a semitubular punch rivet is supplied and positioned in front of the punch head of a commercially available punch riveter, the clamping device is moved down so that it presses together the sheets to be riveted and presses them against the die situated on the component bottom side. In this way, the adhesive previously applied to the interior sides of the sheets to be connected is distributed. For this purpose, clamping forces of 2 to 10 kN are applied via the clamping device for a period of time of 0.1 to 2 seconds.

Subsequently, the punch having the pre-mounted semitubular punch rivet moves toward the sheets and penetrates the uppermost sheet, while expanding in the lowermost sheet because of the die under the lowermost sheet, without exiting from the sheet. This procedure lasts approximately 0.5 seconds. Setting forces of up to 90 kN are applied, depending on the sheet material and thickness.

Other objects, advantages and novel features of the present invention will become apparent from the following detailed description of the invention when considered in conjunction with the accompanying drawings.

BRIEF DESCRIPTION OF THE DRAWING

The single FIGURE illustrates the method according to the present invention in greater detail by providing a method sequence schematically having positions I through IV.

DETAILED DESCRIPTION OF THE DRAWING

In the FIGURE, the punch is identified by 1, the clamping device by 2, the semitubular punch rivet by 3, the two sheets to be connected by 4 and 5, and the die by 6.

In the method according to the present invention, the semitubular punch rivet 3 is also supplied in front of the punch head 1 in a known manner (position I).

Subsequently, the punch riveter is positioned at the rivet point, so that the die 6 presses against the lower sheet 5 and the clamping device 2 is above the upper sheet 4 with the punch 1 and the semitubular punch rivet 3 (position II).

The punch 1 then moves with the semitubular punch rivet 3 in the direction toward the upper sheet 4, far enough that the semitubular punch rivet 3 contacts the sheet surface (position III), while the clamping device 2 still stops shortly before the surface of the uppermost sheet 4, without touching it. A clamping force of 2 to 10 kN is then applied via the semitubular punch rivet 3 for 0.1 to 2 seconds. This clamping force is used to distribute the adhesive between the sheets 4 and 5.

The clamping force exerted on the semitubular punch rivet 3 is then increased up to the setting force of the semitubular punch rivet 3 of up to 75 kN, so that the semitubular punch rivet 3 is driven into the sheets 4 and 5 to be connected (position IV).

Because the die 6 is present below the lowermost sheet 5, the semitubular punch rivet 3 is expanded in a typical way within the lowermost sheet 5, without exiting from this sheet 5.

In the following, the present invention is explained on the basis of an example. In each example, the same material, the same semitubular punch rivet, and the same adhesive are used for punch riveting according to the prior art and according to the present invention.

EXAMPLE 1

| | |
|---|---|
| upper sheet material: | AC-300 (aluminum 6060), sheet thickness: 2.5 mm, |
| lower sheet material: | H 220 LAD (steel), sheet thickness: 1.42 mm, |

-continued

| | |
|---|---|
| adhesive between the sheets: | Betamate 1480, semitubular punch rivet made of steel, C geometry, 5.3 × 5 mm, hardness 4 |
| Punch rivet method: | |
| prior art: clamping force via clamping device: 6 kN, setting force: 43 kN | present invention: clamping force via punch rivet: 6 kN, setting force: 34 kN |

EXAMPLE 2

| | |
|---|---|
| upper sheet material: | ZSTE 420 BH (steel), sheet thickness: 1.0 mm, |
| lower sheet material: | EN AW 5454 (aluminum), sheet thickness: 1.2 mm, |
| adhesive between the sheets: | Betamate 1496, semitubular punch rivet made of steel, C geometry, 5.3 × 5 mm, hardness 4 |
| Punch rivet method: | |
| prior art: clamping force via clamping device: 6 kN, setting force: 50 kN | present invention: clamping force via punch rivet: 6 kN, setting force: 40 kN |

As these two examples show, the setting force may be reduced by over 20% according to the present invention. Therefore, lighter punch riveters may be used for the same application.

It has also been demonstrated that in the method according to the present invention, the adhesive is distributed significantly more uniformly between the sheets. The air channels in the adhesive layer observed up to this point in the prior art are significantly reduced and/or no longer occur.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A self-piercing riveting method for connecting at least two components using a punch riveter having a punch, the method comprising the acts of:

pressing together the at least two components to be connected exclusively via a punch rivet to be set, before setting of the rivet, to substantially remove any potentially existing gap between the at least two components; and subsequently setting the punch rivet via the punch riveter.

2. The method according to claim 1, further comprising the act of awaiting a defined time at a constant clamping force after the pressing together of the two components using the punch rivet to be set.

3. The method according to claim 2, wherein the defined time is in a range of from 0.1 to 2 seconds.

4. The method according to claim 3, wherein the constant clamping force during the defined time is in a range of from 2 to 10 kN.

5. The method according to claim 2, wherein the constant clamping force during the defined time is in a range of from 2 to 10 kN.

6. The method according to claim 1, further comprising the act of applying an adhesive between the two components to be connected; and after pressing together the two components using the punch rivet to be set, awaiting a defined time at a variable clamping force.

7. The method according to claim 6, wherein the defined time is in a range of from 0.1 to 2 seconds.

8. The method according to claim 7, wherein the constant clamping force during the defined time is in a range of from 2 to 10 kN.

9. The method according to claim 6, wherein the constant clamping force during the defined time is in a range of from 2 to 10 kN.

10. The method according to claim 1, wherein the at least two components are two metal sheets.

11. The method according to claim 1, wherein the punch rivet is a semi-tubular punch rivet.

12. A method for applying a clamping force in a self-piercing riveter that presses together at least two components prior to setting a punch rivet that connects the two components, the method comprising the act of:

arranging a punch rivet on a punch of a riveter; and applying a defined clamping force by the riveter exclusively through the punch rivet to be set for a defined time prior to setting of the punch rivet.

13. The method according to claim 12, wherein during the defined time, the clamping force is maintained constant.

14. The method according to claim 12, wherein during the defined time, the clamping force is varied.

15. The method according to claim 12, wherein the defined time is in a range of from 0.1 to 2 seconds.

16. The method according to claim 15, wherein the clamping force during the defined time is in a range of from 2 to 10 kN.

17. The method according to claim 12, wherein the clamping force during the defined time is in a range of from 2 to 10 kN.

18. A self-piercing riveting method using a punch riveter having a punch, the method comprising the acts of:

arranging a punch rivet in front of the punch of the punch riveter;

applying a clamping force exclusively by pressing the punch rivet via the punch directly against one of at least two components to be riveted together in order to substantially remove any potentially existing gap between the at least two components, the clamping force being applied prior to setting of the rivet; and subsequently setting the punch rivet by the punch riveter.

19. The method according to claim 18, further comprising the act of guiding the punch rivet toward the one component using a clamping device, said clamping device not applying any clamping device force against the one component during punch riveting operation.

20. The method according to claim 19, wherein the at least two components are metal sheets.

21. A method of manufacturing a vehicle, the method comprising the acts of:

applying a clamping force at a rivet point exclusively via a punch rivet pressed by a punch of a self-piercing punch riveter directly against one of at least two metal sheets to be riveted together to form at least a portion of a body of the vehicle, the clamping force being applied to substantially remove any potential gap existing between the two metal sheets at the rivet point; and subsequently setting the punch rivet via the punch riveter.

* * * * *